US007137149B2

(12) United States Patent
Kronenberger

(10) Patent No.: US 7,137,149 B2
(45) Date of Patent: Nov. 21, 2006

(54) ORNAMENTATION FOR APPAREL ARTICLE

(76) Inventor: Ronald Kronenberger, 320 Portwine Rd., Riverwoods, IL (US) 60015

( * ) Notice: Subject to any disclaimer, the term of this patent is extended or adjusted under 35 U.S.C. 154(b) by 0 days.

(21) Appl. No.: 11/053,964

(22) Filed: Feb. 9, 2005

(65) Prior Publication Data

US 2006/0143791 A1 Jul. 6, 2006

Related U.S. Application Data

(63) Continuation-in-part of application No. 11/013,026, filed on Dec. 15, 2004.

(51) Int. Cl.
*A42B 1/00* (2006.01)

(52) U.S. Cl. ..... 2/195.1

(58) Field of Classification Search ..... 2/171, 2/173.5, 184, 195.1

See application file for complete search history.

(56) References Cited

U.S. PATENT DOCUMENTS

D133,456 S * 8/1942 Wilson ..... D5/65
4,776,043 A * 10/1988 Coleman ..... 2/209.12
5,359,734 A * 11/1994 Rathburn ..... 2/195.1
5,817,393 A 10/1998 Stahl
5,974,997 A * 11/1999 Amburgey ..... 112/475.01
6,158,055 A * 12/2000 Park ..... 2/195.1
6,675,512 B1 * 1/2004 Shwartz et al. ..... 40/329
6,883,449 B1 * 4/2005 Burrell et al. ..... 112/475.19

OTHER PUBLICATIONS

Fairchild's Textile Dictionary, 7th edition. Phyllis G. Tortora & Robert S. Merketl. Fairchild Publicaitons, New York. 2000.*

* cited by examiner

*Primary Examiner*—Gary L. Welch
*Assistant Examiner*—Richale L. Haney
(74) *Attorney, Agent, or Firm*—Wood, Phillips, Katz, Clark & Mortimer

(57) ABSTRACT

A headwear piece having a crown defining an opening for receiving a wearer's head with the headwear piece in an operative position on the wearer's head. The headwear piece has an exposed surface. Ornamentation is applied to the exposed surface of the headwear piece. The ornamentation has a substrate layer that is separate from and secured to the exposed surface of the headwear piece, and a design piece separately formed from and attached in relationship to the substrate layer. The substrate layer has a perimeter edge. The design piece has thread that is formed to produce at least a part of a viewable design. The design piece further has a perimeter edge. The substrate layer extends beyond the perimeter edge of the design piece to define a frame surface at least partially around the perimeter edge of the design piece. The perimeter edge of the substrate layer has a shape that at least nominally conforms to a shape of the perimeter edge of the design piece at least partially around the perimeter edge of the design piece.

21 Claims, 3 Drawing Sheets

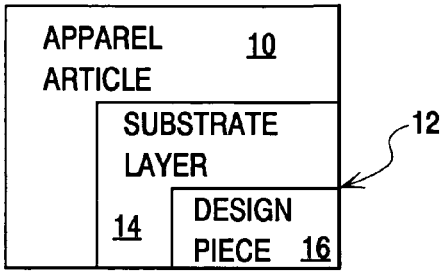
Fig. 1
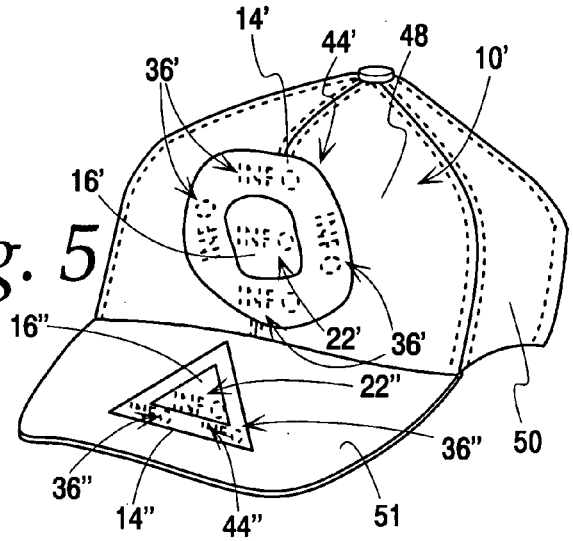
Fig. 5
Fig. 3
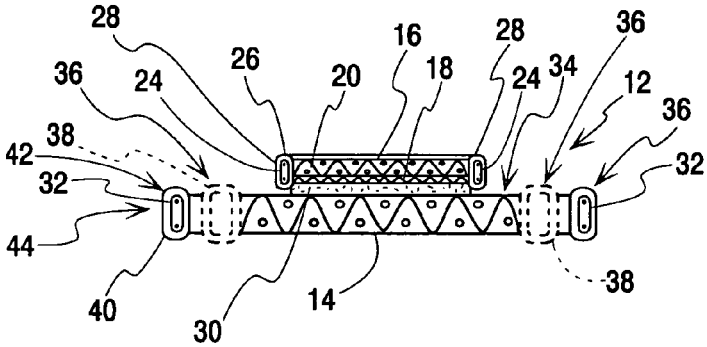
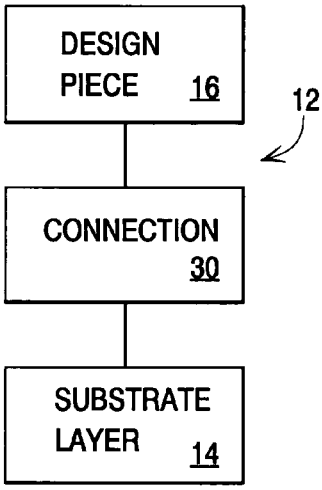
Fig. 4
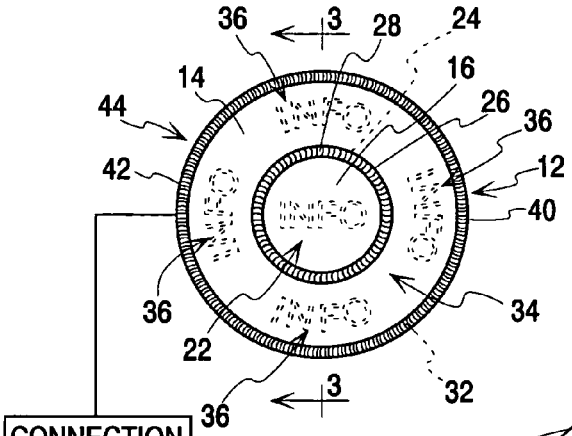
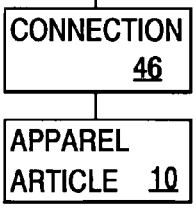
Fig. 2
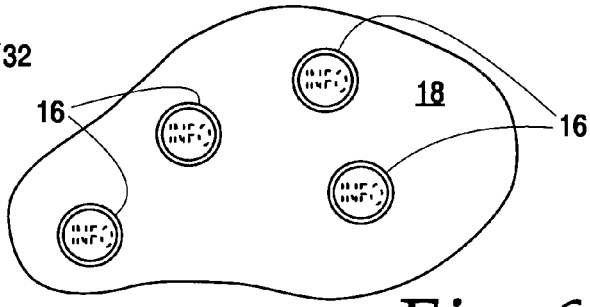
Fig. 6

ORNAMENTATION FOR APPAREL ARTICLE

CROSS REFERENCE

This application is a continuation-in-part of my co-pending application Ser. No. 11/013,026 filed Dec. 15, 2004.

BACKGROUND OF THE INVENTION

1. Field of the Invention

This invention relates to apparel and, more particularly, to ornamentation that can be placed thereon for purposes of aesthetics and/or to convey information.

2. Background Art

Many different apparel articles, such as headwear, shirts, jackets, purses, etc. have ornamentation thereon that enhances the appearance thereof and/or conveys information, such as the identity of: a) a person, place, or thing; b) an event; c) competitors in an event, etc. For purposes of explanation herein, the focus will be on ornamentation applied to headwear, with it being understood that the ornamentation can be similarly applied to any other apparel article.

Headwear, and more specifically baseball-style caps, to include baseball caps, visors, etc., is commonly adorned by applications to external surfaces of a crown, which accommodates a wearer's head. Numerous different techniques are utilized to apply this ornamentation.

As one example, thread may be embroidered directly against the crown. Since it is common to make the basic headwear piece before the application of ornamentation, this procedure has a number of drawbacks. First of all, the embroidery process is carried out on a curved surface. This introduces problems both in terms of handling the headwear piece during the embroidery operations and aligning the stitching material with the curved surface. Improper coordination between the headwear piece and embroidery machinery may produce a less than desired quality of product.

As an alternative to directly embroidering on the crown, or an associated brim/bill, it is known to pre-form patches in a flattened state and thereafter apply the same to the headwear piece. A typical patch may consist of a substrate layer to which thread is applied through weaving or embroidery operations.

Modern techniques for producing woven labels permit relatively fine and intricate detail to be integrated into the patch. However, inherently, the processes to produce patches through weaving are more time consuming, and, thus more expensive than those used to embroider. Consequently, woven patches are generally made relatively small in size for use on mass-produced headwear. While woven patches are desirable from an aesthetic standpoint, they are often opted away from in favor of embroidered patches which, in the same price range, can be made larger to be more dominant and eye catching. The above problems are common to weaving operations that are performed directly upon the crown as well as those that employ a separate substrate layer to produce a patch that is subsequently applied to the headwear.

Consequently, the industry has maintained different categories of product. Headwear with ornamentation applied through weaving operations has generally been in the high-end category and such that the ornamentation is more discrete in appearance. Ornamentation applied through conventional embroidery procedures offers more opportunity to be applied over a substantial areal extent, while maintaining cost at a relatively low level. The latter result is achieved at the expense of clarity, definition, and detail of the subject matter formed on the headwear, either directly or through separately applied patches.

Those in the headwear industry compete often based on the quality of the ornamentation. Designers must balance the quality of the ornamentation versus the price that the consumer is willing to pay for the associated products.

SUMMARY OF THE INVENTION

In one form, the invention is directed to a headwear piece having a crown defining an opening for receiving a wearer's head with the headwear piece in an operative position on the wearer's head. The headwear piece has an exposed surface. Ornamentation is applied to the exposed surface of the headwear piece. The ornamentation has a substrate layer that is separate from and secured to the exposed surface of the headwear piece, and a design piece separately formed from and attached in relationship to the substrate layer. The substrate layer has a perimeter edge. The design piece has thread that is formed to produce at least a part of a viewable design. The design piece further has a perimeter edge. The substrate layer extends beyond the perimeter edge of the design piece to define a frame surface at least partially around the perimeter edge of the design piece. The perimeter edge of the substrate layer has a shape that at least nominally conforms to a shape of the perimeter edge of the design piece at least partially around the perimeter edge of the design piece.

In one form, the thread is woven to produce the at least part of the viewable design.

In one form, the viewable design consists of first information related to a first subject matter and second information related to the first subject matter and applied to the substrate layer around the design piece.

The perimeter edges may be rounded.

The second information may be formed in a curved shape around the design piece.

In one form, the second information is applied to the substrate layer using thread.

In one form, the substrate layer is made from a material that can be cut without causing fraying.

The substrate layer may be made from felt, or other material.

In one form, the design piece overlies the substrate layer.

The frame may have a substantially uniform width through at least 180° around the perimeter edge of the design piece.

In one form, the substrate layer is sewn to the headwear piece by thread directed through the frame surface.

The ornamentation may be applied to the crown.

The invention is further directed to a headwear piece having a crown defining an opening for receiving a wearer's head with the headwear piece in an operative position on the wearer's head. The headwear piece has an exposed surface. Ornamentation is applied to the exposed surface of the headwear piece. The ornamentation includes a substrate layer that is separate from and secured to the exposed surface of the headwear piece and a design piece separately formed from and attached in relationship to the substrate layer. The substrate layer has a perimeter edge. The design piece has thread that is formed to produce at least a part of a viewable design. The design piece has a perimeter edge. The substrate layer extends beyond the perimeter edge of the design piece to define a frame surface at least partially around the perimeter edge of the design piece the perimeter edge of the design piece is circumscribed by a first circle with a first diameter. The perimeter edge of the substrate layer is circumscribed by a second circle with a second diameter. The second diameter is not more than 1.5 times the first diameter.

The thread may be woven to produce the at least part of the viewable design.

In one form, the perimeter edge of the substrate layer has a shape that at least nominally conforms to a shape of the perimeter edge of the design piece at least partially around the perimeter edge of the design piece.

The shape of the perimeter edge of the substrate layer may at least nominally conform to the shape of the perimeter edge of the design piece substantially fully around the perimeter edge of the design piece.

The invention is further directed to an apparel article having a sheet layer defining an exposed surface. Ornamentation is applied to the exposed surface. The ornamentation includes a substrate layer that is separately formed from and secured to the exposed surface of the sheet layer, and a design piece separately formed from and attached in relationship to the substrate layer. The substrate layer has a perimeter edge. The design piece includes thread that is formed to produce at least a part of a viewable design. The design piece has a perimeter edge. The substrate layer extends beyond the perimeter edge of the design piece to define a frame surface at least partially around the perimeter edge of the design piece.

The perimeter edge of the substrate layer has a shape that at least nominally conforms to the shape of the perimeter edge of the design piece at least partially around the perimeter edge of the design piece.

The thread may be woven to produce the at least part of the viewable design.

The invention is further directed to an apparel article having a sheet layer defining an exposed surface and ornamentation applied to the exposed surface. The ornamentation includes a substrate layer, that is separately formed from and secured to the exposed surface of the sheet layer, and a design piece separately formed from and attached in relationship to the substrate layer. The substrate layer has a perimeter edge. The design piece has thread that is formed to produce at least a part of a viewable design. The design piece has a perimeter edge. The substrate layer extends beyond the perimeter edge of the design piece to define a frame surface at least partially around the perimeter edge of the design piece. The perimeter edge of the design piece is circumscribed by a first circle with a first diameter. The perimeter edge of the substrate layer is circumscribed by a second circle with a second diameter. The second diameter is not more than 1.5 times the first diameter.

In one form, the thread is woven to produce the at least part of the viewable design.

The invention is further directed to the combination of an apparel article having a sheet layer defining an exposed surface, a first substrate layer with a perimeter edge, a second substrate layer with a perimeter edge, and a design piece having thread that is formed to produce at least a part of a viewable design. The design piece has a perimeter edge. The design piece is attachable to the exposed surface of the sheet layer in relationship to either of the substrate layers that is selected in the same manner such that the selected substrate layer extends beyond the perimeter edge of the design piece to define a frame surface at least partially around the perimeter edge of the selected design piece. The first substrate layer has at least one of a different composition or shape than the second substrate layer.

In one form, the perimeter edge of the selected substrate layer has a shape that at least nominally conforms to a shape of the perimeter edge of the design piece at least partially around the perimeter edge of the design piece.

The frame surface may have a width along at least a portion thereof in the range of 1/16 to 3/4 inch.

In one form, the frame surface has a substantially uniform width through at least 180° around the perimeter edge of the design piece.

The thread may be woven to produce the at least part of the viewable design.

BRIEF DESCRIPTION OF THE DRAWINGS

FIG. 1 is a schematic representation of an apparel article, with ornamentation according to the present invention thereon, and consisting of a substrate layer with an attached design piece that define a patch;

FIG. 2 is an elevation view of the inventive ornamentation in FIG. 1 in the form of a rounded/circular patch;

FIG. 3 is a cross-sectional view of the ornamentation taken along lines 3—3 of FIG. 2;

FIG. 4 is a schematic representation of the ornamentation in FIGS. 1–3 and showing a generic connection between the design piece and substrate layer;

FIG. 5 is a perspective view of a headwear piece, representative of the apparel article in FIG. 1, and with ornamentation according to the invention in two different forms attached to the crown and brim/bill;

FIG. 6 is a plan view of a substrate layer upon which a plurality of design pieces are formed;

DETAILED DESCRIPTION OF THE DRAWINGS

Figure 7:
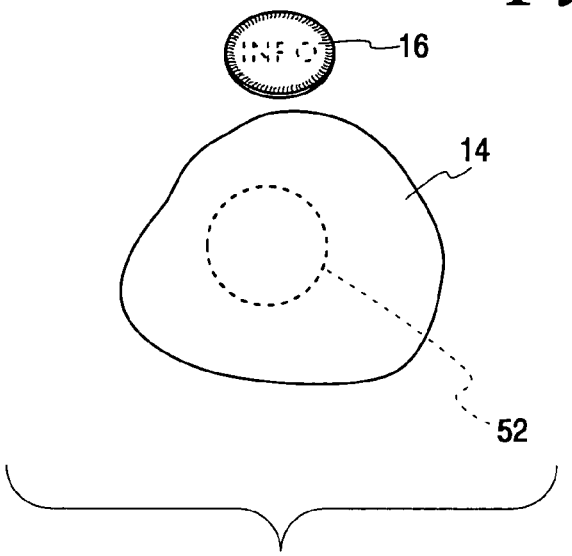
FIG. 7 is an exploded perspective view of a substrate layer to which the inventive design piece is attached.

In FIG. 1, an apparel article, according to the present invention, is shown at 10. The apparel article 10 is shown in a schematic form intended to encompass every conceivable apparel article, such as, but not limited to, hats, shirts, coats, pants, ties, shoes and socks, and accessories, such as purses, headbands, etc. Generally, the apparel article 10 has a sheet layer, to which ornamentation 12 according to the present invention is applied.

One form of the ornamentation 12 is shown additionally in FIGS. 2 and 3. The ornamentation 12 consists of a substrate layer 14 to which a design piece 16 is attached. In a preferred form, the design piece 16 is separately formed from the substrate layer 14. The design piece 16 has a separate substrate layer 18 to which thread 20 is applied to produce a viewable design, as shown at 22 in FIG. 2. The viewable design 22 is identified as "INFO", intended to generically encompass virtually a limitless number of different designs. For example, the design may be in the nature of a picture, a logo, words, numbers, etc. Regardless of the nature of the design, it is intended that the design convey some sort of information, either directly or indirectly.

The design piece 16 has a perimeter shape bounded by an edge 24. In this embodiment, thread 26 is wrapped/embroidered around the perimeter edge 24 to produce a raised bead that defines a border line 28. The substrate layer 14 may be any sheet layer, such as one made from fabric, plastic, leather, metal, etc. As shown in FIG. 4, the design piece 16 is attached to the substrate layer 14 through an appropriate connection 30, which may be stitching, an adhesive, or other means known to those skilled in the art. In the exemplary embodiment shown in FIGS. 2 and 3, an adhesive layer 30 is shown for the connection.

The substrate layer 14 has a perimeter edge 32 that is spaced uniformly from the perimeter edge 24 of the design piece 16, in this embodiment, fully around the design piece 16. This produces an exposed, annular frame surface 34 around the design piece 16 upon which additional information, shown generically at 36, can be applied. The substrate layer 14 maintains the entirety of the design piece 16 spaced from the surface to which the ornamentation 12 is applied fully within the perimeter edge 32 of the substrate layer 14. In this embodiment thread 38 is used to define the information 36. Again, the nature of the information 36 is not limited in any manner.

A separate thread 40 is wrapped/embroidered around the perimeter edge 32 to define a raised bead 42 which defines a surrounding line. The bead/surrounding line 42 might alternatively be spaced inwardly from the perimeter edge 32. The information 36 is shown applied in a curved shape corresponding to that between the lines 28, 42.

The combined design piece 16 and substrate layer 14 define a patch at 44 that can be applied to an exposed surface of the apparel article 10 through an appropriate connection 46. The connection 46 may be in the form of thread, an adhesive, or other means, known to those skilled in this art, which facilitates attachment to the apparel article 10.

In a preferred form, the viewable design 22 on the design piece 16 is formed by weaving the thread 20. This permits high quality, detailed information to be formed for the viewable design 22. However, a virtually unlimited number of other methods of forming this information are contemplated. As one example, the information 22 may be in the nature of a logo, a picture, a representation of a place, location or event, etc. The information 36 preferably relates to the information 22. Thread 38 defining the information 36 may be applied as by using conventional embroidery techniques, or by any other means known to those skilled in this art.

As examples of the coordination between the information 22, 36, the information 22 may be a team logo. The information 36 may be a word identification associated with that team. As a further example, the information 22 may relate to an event or an organization, with the information 36 more specifically describing something associated with that organization or event. The information 22 might be a logo for a particular golf venue, with the information 36 identifying a tournament that is played a particular year. Alternatively, the information 22 may identify a competition, with the information 36 identifying an aspect of the competition, which may be its location, the entities competing, etc.

In this embodiment, the perimeter shapes of the design piece 16 and substrate layer 14 correspond and are round. The border line 28 and surrounding line 42 are circular and concentric. It is not necessary, however, that the peripheral shapes of the design piece 16 and substrate layer 14 be corresponding, or that they be circular in shape. The circular shape is selected for its aesthetic appeal.

In FIG. 5, an exemplary apparel article 10' in the form of headwear piece is shown with a patch 44' applied to an exposed surface 48 of a crown 50. The patch 44' consists of a substrate layer 14' to which a design piece 16' is applied. The design piece 16' has information 22' thereon, with the surrounding substrate layer 14 having information 36' thereon. In this embodiment, the substrate layer 14 has a random shape, with the design piece 16' having a non-conforming shape.

As a further alternative, as shown in FIG. 5, a patch 44" is shown applied to a brim/bill 51 with a substrate layer 14" having a triangular shape, with the design piece 16" having a conforming shape and applied thereto. The design piece 16" has information 22" applied thereto, with the substrate layer 14" having information 36" applied thereto.

The ornamentation 12 lends itself to being manufactured in a number of different ways. As shown in FIG. 6, the substrate layer 18 may be defined as a sheet with an area that is substantially greater than that of the design piece 16. The design piece 16 may be formed on the substrate layer 18 and subsequently cut therefrom. The design piece 16 can then be combined with the substrate layer 14 in any of a number of different ways. Three exemplary ways are shown in FIGS. 7–9.

In FIG. 7, a continuous sheet of the substrate layer 14 is provided to which the design piece 16 is applied. Thereafter, the substrate layer 14 is cut, as at the line 52, to produce the desired overall shape for the resulting patch 44.

Figure 8:
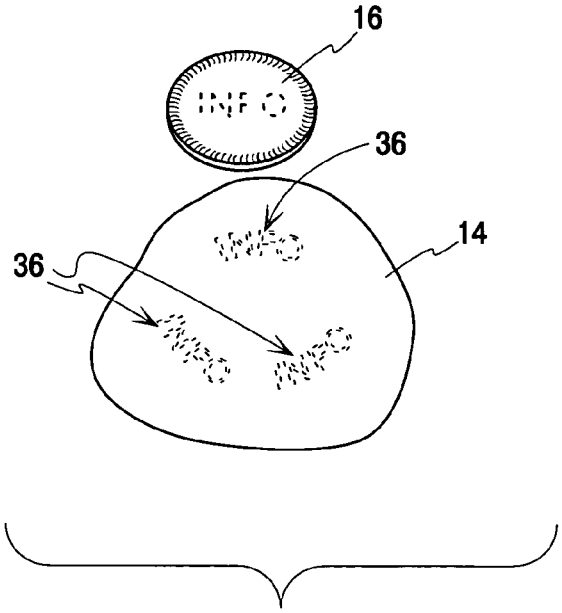
FIG. 8 is a view as in FIG. 7 wherein information is applied to the substrate layer before the design piece is attached thereto.

In FIG. 8, the information 36 is applied to the substrate layer 14 with the substrate layer 14 in continuous sheet form. The substrate layer 14 can then be cut to produce the desired outline for the patch.

Figure 9:
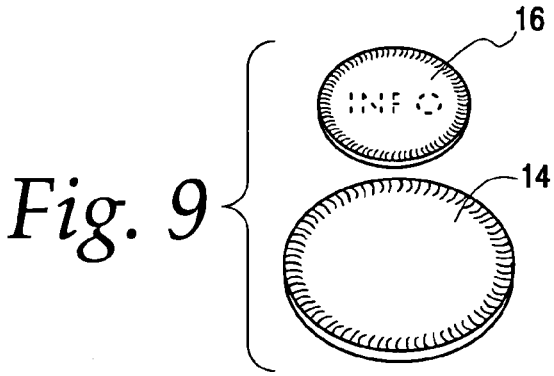
FIG. 9 is a view as in FIGS. 7 and 8 wherein the substrate layer is cut to an end size before the design piece is attached thereto.

As a further alternative, as shown in FIG. 9, the substrate layer 14 is pre-cut to the desired end patch shape, after which the design piece 16 is applied. The information 36 may be applied to the substrate layer 14 before or after application of the design piece 16.

Other variations of these methods are contemplated.

Figure 10:
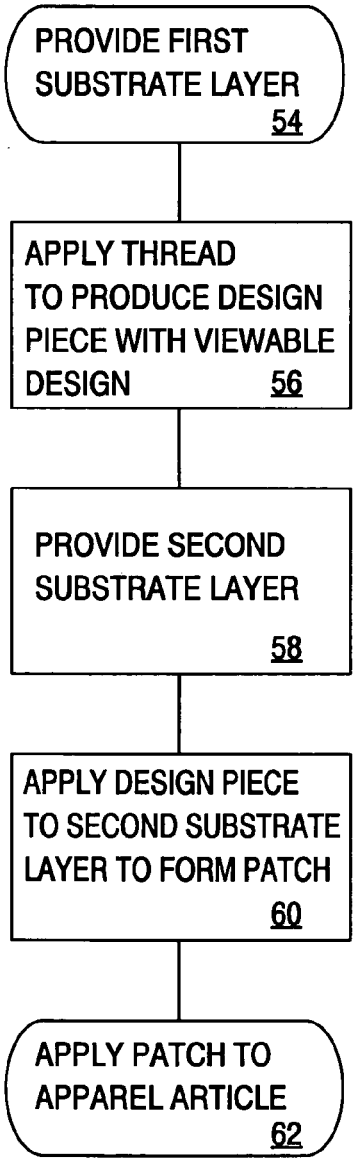
FIG. 10 is a flow diagram representation of a method of producing ornamentation for an apparel article, according to the invention.

A generic form of method for producing ornamentation on an apparel article is shown in FIG. 10 in flow diagram form. As shown at block 54, a first substrate layer is provided. As shown at block 56, thread is applied to produce a design piece with a viewable design. A second substrate layer is provided as shown at block 58. The design piece is applied to the second substrate layer to form a patch, as shown at block 60. As shown at block 62, the patch is applied to the apparel article.

It is also contemplated that each patch 44 could be attached to an apparel article 10 in a manner to be separable therefrom, as described in co-pending U.S. application Ser. No. 10/726,877, entitled "Method of Adorning an Article and an Adorned Article Made Using the Method", which is incorporated herein by reference. To accomplish this, the connection 46 may be effected by spot stitching or virtually any other type of sewing or stitching that allows the thread to be cut to separate the patch 44. The patch 44 can be replaced with another patch at the same or different location on an apparel article. This allows the method in application Ser. No. 10/726,877 to be practiced, whereby customers can remove and replace ornamentation as dictated by an event, or otherwise by a particular demand.

Figure 11:
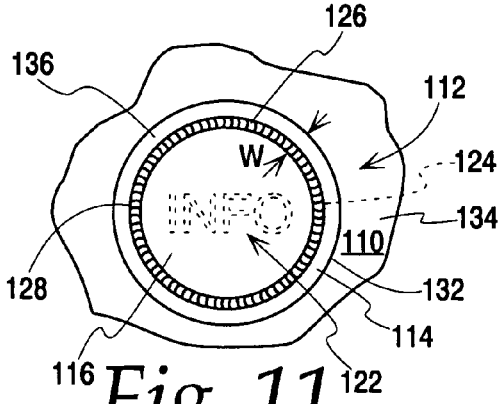
FIG. 11 is a fragmentary, elevation view of an apparel article with a further modified form of ornamentation, according to the present invention, including a design piece fixed in relationship to a substrate layer.
Figure 12:
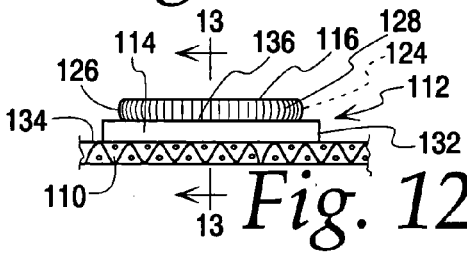
FIG. 12 is a view of the ornamentation, as in FIG. 11, and viewed from a perspective turned 90° from that in FIG. 11.
Figure 13:
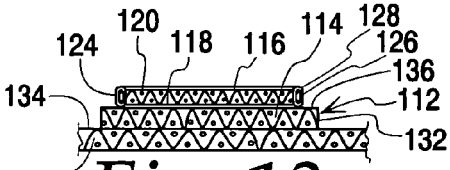
FIG. 13 is a cross-sectional view of the ornamentation on the apparel article taken along line 13—13 of FIG. 12.

Variations of the inventive structure are shown in FIGS. 11–23. Referring initially to FIGS. 11–13, an apparel article 110 is shown having ornamentation 112. The ornamentation 112 consists of a substrate layer 114 and a design piece 116, separately formed from and attached in relationship to the substrate layer 114. The design piece 116 may be applied over the substrate layer 114 or may be fixed in a complementarily-shaped opening therein.

The design piece 116 may be formed in the same manner as any of the design pieces 16, 16', 16", described above. That is, the design piece 116 has a second substrate layer 118 to which thread 120 is woven to produce a viewable design 122, identified generically as "INFO" in FIG. 11. The design piece 116 has a perimeter edge 124 about which thread 126 is wrapped/embroidered to produce a bead/borderline 128. The bead/borderline 128 is optional. The structure for connecting the design piece 116 to the substrate layer 114 is not shown in detail in FIGS. 11–13, but could take any form, described above, or any other form well known to those skilled in this art.

The substrate layer 114 has a perimeter edge 132, which in this embodiment is shown without a bead/borderline formed by wrapped/embroidered thread. The substrate layer 114 is suitably applied to an exposed surface 134 on the apparel article 110 through an appropriate means including, but not limited to, those described above.

In this embodiment, the perimeter edge 124 of the design piece 116 lies fully within the perimeter edge 132 of the substrate layer 114. By reason of the substrate layer 114 extending beyond the perimeter edge 124 of the design piece 116, a frame surface 136 is defined, in this case fully around the perimeter edge 124 of the design piece 116. As explained in detail below, the perimeter edge 132 of the substrate layer 114 has a shape that at least nominally conforms to the shape of the perimeter edge 124 of the design piece 116 at least partially around the perimeter edge 124 of the design piece 116. In this embodiment, there is substantial conformity around the entire peripheral extent of the perimeter edge 124.

By reason of the conformity of the perimeter edges 124, 132, the frame surface 136 has a uniform width W (FIG. 11). The width W is controlled to produce a unique highlighting of the viewable design 122 on the design piece 116, without diminishing the effect thereof. By controlling the width W to a dimension in the range of 1/16 to 3/4 inches, and more preferably 1/16 to 1/4 inch, a shadowing/highlighting effect can be realized so as to accent, but not dominate, the viewable design 122. The provision of information on the frame surface 136 is optional. With a smaller width W, it may be preferred to not have information thereon.

To facilitate the formation of a sharp perimeter edge 132, the substrate layer 114 may be made from a material that does not fray when it is cut. For example, the substrate layer 114 may be made from a felt material that may be color coordinated to enhance the combined appearance of the substrate layer 114 and the design piece 116.

Figure 14:
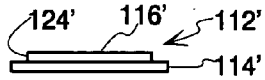
FIG. 14 is a view as in FIGS. 12 and 13 of a modified form of ornamentation, according to the invention, including a design piece and substrate layer, having a different construction than that shown in FIGS. 11–13.

The substrate layer 114 can be made from virtually any type of material to provide support for, and contrast with, the design piece 116. For example, as shown for the ornamentation 112' in FIG. 14, the substrate layer 114' is shown generically to represent other materials, which may be metal, plastic, a composite, or the like. In FIG. 14, a design piece 116' is shown with a perimeter edge 124' lacking a bead/borderline corresponding to that shown at 128 in FIGS. 11–13.

Figure 15:
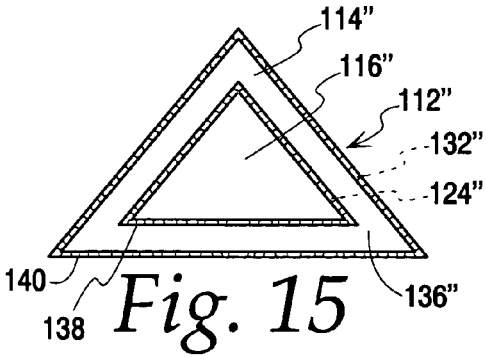
FIG. 15 is an elevation view of a further modified form of ornamentation, according to the invention, and having a conformingly shaped design piece and substrate layer with a different shape than shown on the ornamentation in FIGS. 11–13.

In FIG. 15, ornamentation 112" is shown with a triangularly-shaped design piece 116" and a complementarily-shaped substrate layer 114". The perimeter edges 124", 132" of the design piece 116" and substrate layer 114", respectively, are oriented so that the frame surface 136" has a uniform width fully around the perimeter of the design piece 116". Beads/borderlines 138, 140 are defined by wrapped/embroidered thread around the perimeter edges 132", 134", respectively.

Figure 16:
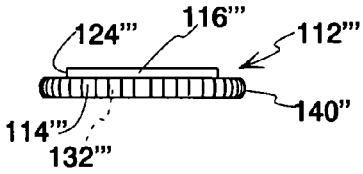
FIG. 16 is a view corresponding to that in FIG. 14 wherein the substrate layer has a different configuration than the substrate layer on the design piece in FIG. 14.

In FIG. 16, ornamentation 112''' is shown with a design piece 116''' having a perimeter edge 124''' without any bead/borderline. In this embodiment, the perimeter edge 132''' of the substrate layer 114''' is wrapped/embroidered with thread to produce a bead/borderline 140'''.

Figure 17:
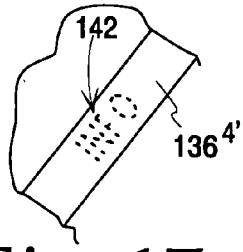
FIG. 17 is a fragmentary, elevation view of ornamentation, according to the invention, and showing a portion of a design piece in relationship to a substrate layer defining a frame surface with information thereon.
Figure 18:
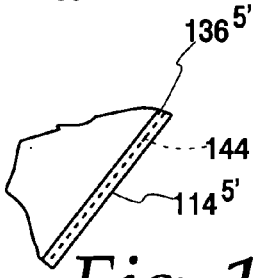
FIG. 18 is a view as in FIG. 17 wherein the frame surface has a narrower width and stitching applied therethrough.
Figure 19:
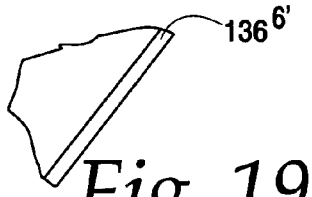
FIG. 19 is a view as in FIG. 18 with there being no stitching through the frame surface.

In FIGS. 17–19, different frame surface configurations are shown at $\mathbf{136}^{4x'}$, $\mathbf{136}^{5x'}$, $\mathbf{136}^{6x'}$, consecutively. The frame surface $\mathbf{136}^{4x'}$ has information 142 thereon that is independent of, or related to, any information on an associated design piece (not shown). The frame surface $\mathbf{136}^{4x'}$ has a greater width than the corresponding frame surfaces $\mathbf{136}^{5x'}$ and $\mathbf{136}^{6x'}$ in FIGS. 18 and 19. The frame surface width shown in FIGS. 18 and 19 is at the lower end of a preferred range and in FIG. 18 is shown to have a sufficient dimension to receive a line of stitching 144 which may be used to attach the substrate layer $\mathbf{114}^{5x'}$ to the apparel article 110. In FIG. 19, a corresponding width is shown for the frame surface $\mathbf{124}^{6x'}$, without any stitching as in FIG. 18.

Figure 20:
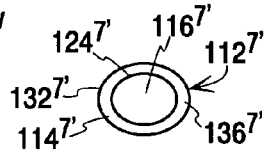
FIG. 20 is a view corresponding to that in FIG. 15 of a modified form of ornamentation, according to the invention, and having a rounded/elliptically-shaped design piece and substrate layer.

In FIG. 20, ornamentation is shown at $\mathbf{112}^{7x'}$ having a rounded/elliptical design piece $\mathbf{116}^{7x'}$ and a complementarily-shaped substrate layer $\mathbf{114}^{7x'}$. FIG. 20 is intended to represent generically any ornamentation $\mathbf{112}^{7x'}$ with design pieces $\mathbf{116}^{7x'}$ and substrate layers $\mathbf{114}^{7x'}$ having round or rounded perimeter edges $\mathbf{124}^{7x'}$, $\mathbf{132}^{7x'}$, respectively. The rounded shapes may vary significantly from round or elliptical and may be such as to produce a uniform or non-uniform width for the frame surface $\mathbf{136}^{7x'}$.

Figure 21:
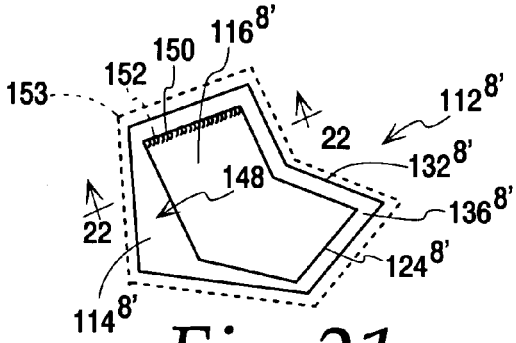
FIG. 21 is a view as in FIGS. 15 and 20 of a further modified form of ornamentation, according to the invention, and having a substrate layer corresponding in shape to a design piece only partially around a perimeter edge of the design piece.
Figure 22:
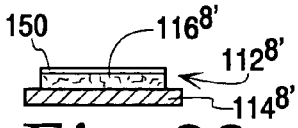
FIG. 22 is a cross-sectional view of the ornamentation taken along line 22—22 of FIG. 21.

As an alternative to a rounded shape, in FIGS. 21 and 22, ornamentation $\mathbf{112}^{8x'}$ is shown with a random perimeter shape. A design piece $\mathbf{116}^{8x'}$ is attached in relationship to a substrate layer $\mathbf{114}^{8x'}$ The design piece $\mathbf{116}^{8x'}$ has a perimeter edge $\mathbf{124}^{8x'}$ with a shape that nominally conforms to the shape of a substantial part of the periphery of the perimeter edge $\mathbf{132}^{8x'}$ of the substrate layer $\mathbf{114}^{8x'}$. In this embodiment, the frame surface $\mathbf{136}^{8x'}$ has a width that is substantially uniform around a substantial portion of the perimeter edge $\mathbf{124}^{8x'}$. In the region at 148, the width of the frame surface $\mathbf{136}^{8x'}$ changes significantly.

In one form, it is preferred that there be general conformity in the shape of the perimeter edges of the design pieces and substrate layers through at least 180° with respect to a circle circumscribing the ornamentation. However, exact or nominal conformity is not a requirement.

In FIGS. 21 and 22, the substrate layer $\mathbf{114}^{8x'}$ is shown as a solid piece of metal or other material, with the overlying design piece $\mathbf{116}^{8x'}$ having a bead/borderline 150 along one portion 152 of perimeter edge $\mathbf{124}^{8x'}$.

Optionally, in all embodiments, an additional one, or more, substrate layers, shown in dotted lines at 153 in FIG. 21, may be provided with a perimeter shape either having a non-conforming shape, or partially or fully conforming to the perimeter shape of the overlying substrate layer $\mathbf{114}^{8x'}$ and/or design piece $\mathbf{116}^{8x'}$.

Figure 23:
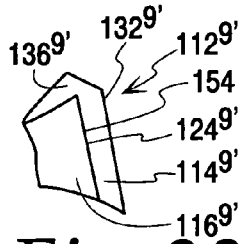
FIG. 23 is a view as in FIGS. 15, 20 and 21 of a further modified form of orientation, according to the invention, wherein the frame surface does not extend fully around the design piece.

In FIG. 23, a further modified form of ornamentation is shown at $\mathbf{112}^{9x'}$ consisting of a design piece $\mathbf{116}^{9x'}$ in relationship to a substrate layer $\mathbf{114}^{9x'}$. The perimeter edge $\mathbf{124}^{9x'}$ of the design piece $\mathbf{116}^{9x'}$ conforms to the perimeter edge $\mathbf{132}^{9x'}$ along only one portion 154 of the perimeter edge $\mathbf{124}^{9x'}$. Elsewhere, the frame surface $\mathbf{136}^{9x'}$ has a random width. Additionally, the ornamentation $\mathbf{112}^{9x'}$, is configured so that the frame surface $\mathbf{136}^{9x'}$ extends only partially around the perimeter edge $\mathbf{124}^{9x'}$ of the design piece $\mathbf{116}^{9x'}$.

Figure 24:
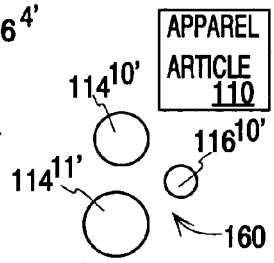
FIG. 24 is a partially schematic representation of a kit to provide ornamentation on an apparel article by selecting between different substrate layers that are usable in combination with a design piece.

The invention also contemplates the provision of a kit, as shown at 160 in FIG. 24. The kit 160 consists of the apparel article 110, a design piece $\mathbf{116}^{10x'}$, representative of all variations heretofore described and others, and two or more, and in this case two, separate substrate layers $\mathbf{114}^{10x'}$, $\mathbf{114}^{11x'}$. The substrate layer $\mathbf{114}^{10x'}$ has a different appearance than the substrate layer $\mathbf{114}^{11x'}$, by reason of a difference in shape, material, color, texture, etc. At the time of applying ornamentation, the user can form the design piece $\mathbf{116}^{10x'}$ and fix the same in relationship to a selected one of the substrate layers $\mathbf{114}^{10x'}$, $\mathbf{114}^{11x'}$ that produces the desired appearance. The relationship between the design piece $\mathbf{116}^{10x'}$ and the substrate layers $\mathbf{114}^{10x'}$, $\mathbf{114}^{11x'}$ may correspond to those described above, or may be different as preference dictates.

In one preferred form, the perimeter edges of the various design pieces are circumscribed by a circle with a first diameter. The associated substrate layers are circumscribed by a second circle having a second diameter. The second diameter is preferably not more than 1.5 times the first diameter. When no information is provided on the associated frame surface, the frame surface produces an accentuation of the design piece without domination thereof.

The foregoing disclosure of specific embodiments is intended to be illustrative of the broad concepts comprehended by the invention.

The invention claimed is:

1. A headwear piece comprising:

a crown defining an opening for receiving a wearer's head with the headwear piece in an operative position on the wearer's head, the headwear piece having an exposed surface; and ornamentation applied to the exposed surface of the headwear piece, the ornamentation comprising a substrate layer, that is separate from and secured to the exposed surface of the headwear piece, and a design piece separately formed from and attached in relationship to the substrate layer, the substrate layer having a perimeter edge, the design piece comprising thread that is woven to produce a viewable design and having a perimeter edge, the substrate layer extending beyond the perimeter edge of the design piece to define a frame surface at least partially around the perimeter edge of the design piece and maintaining the entirety of the design piece spaced from the exposed surface of the headwear piece within the perimeter edge of the substrate layer, the perimeter edge of the substrate layer having a shape that at least nominally conforms to a shape of the perimeter edge of the design piece at least partially around the perimeter edge of the design piece.

2. The headwear piece according to claim 1 wherein the viewable design comprises first information related to a first subject matter and second information related to the first subject matter is applied to the substrate layer around the design piece.

3. The headwear piece according to claim 2 wherein the second information is applied to the substrate layer using thread.

4. The headwear piece according to claim 1 wherein the perimeter edges are rounded.

5. The headwear piece according to claim 4 wherein the second information is formed in a curved shape around the design piece.

6. The headwear piece according to claim 1 wherein the substrate layer comprises a material that can be cut without causing fraying.

7. The headwear piece according to claim 1 wherein the substrate layer comprises felt.

8. The headwear piece according to claim 1 wherein the frame surface has a substantially uniform width through at least 180° around the perimeter edge of the design piece.

9. The headwear piece according to claim 1 wherein the substrate layer is sewn to the headwear piece by thread directed through the frame surface.

10. The headwear piece according to claim 1 wherein the ornamentation is applied to the crown.

11. The headwear according to claim 1 wherein the perimeter edge of the substrate layer is cut and at least part of the perimeter edge of the substrate layer is exposed without any thread wrapped therearound.

12. A headwear piece comprising:

a crown defining an opening for receiving a wearer's head with the headwear piece in an operative position on the wearer's head, the headwear piece having an exposed surface; and ornamentation applied to the exposed surface of the headwear piece, the ornamentation comprising a substrate layer, that is separate from and secured to the exposed surface of the headwear piece, and a design piece separately formed from and attached in overlying relationship to the substrate layer, the substrate layer having a perimeter edge, the design piece comprising thread that is woven to produce a viewable design and having a perimeter edge, the substrate layer extending beyond the perimeter edge of the design piece to define a frame surface at least partially around the perimeter edge of the design piece and maintaining the entirety of the design piece spaced from the exposed surface of the headwear piece within the perimeter edge of the substrate layer, the perimeter edge of the design piece circumscribed by a first circle with a first diameter, the perimeter edge of the substrate layer circumscribed by a second circle with a second diameter, wherein the second diameter is not more than 1.5 times the first diameter.

13. The headwear piece according to claim 12 wherein the perimeter edge of the substrate layer has a shape that at least nominally conforms to a shape of the perimeter edge of the design piece at least partially around the perimeter edge of the design piece and the substrate layer comprises a material that can be cut without causing fraying.

14. The headwear piece according to claim 13 wherein the shape of the perimeter edge of the substrate layer at least nominally conforms to the shape of the perimeter edge of the design piece substantially fully around the perimeter edge of the design piece.

15. The headwear piece according to claim 12 wherein the perimeter edge of the substrate layer is cut and at least part of the perimeter edge of the substrate layer is exposed without any thread wrapped therearound.

16. In combination:

an apparel article comprising a sheet layer defining an exposed surface;

a first substrate layer having a perimeter edge;

a second substrate layer having a perimeter edge; and a design piece comprising thread that is woven to produce a viewable design and having a perimeter edge, the design piece attachable to the exposed surface of the sheet layer in overlying relationship to either of the substrate layers that is selected such that the selected substrate layer extends beyond the perimeter edge of the design piece to define a frame surface at least partially around the perimeter edge of the selected design piece and maintaining the entirety of the design piece spaced from the exposed surface of the headwear piece within the perimeter edge of the substrate layer, wherein the first substrate layer has at least one of a different composition or shape than the second substrate layer.

17. The combination according to claim 16 wherein the perimeter edge of the selected substrate layer has a shape that is at least nominally conforming to a shape of the perimeter edge of the design piece at least partially around the perimeter edge of the design piece and at least one of the substrate layers is made from a material that can be cut without causing fraying.

18. The combination according to claim 17 wherein the frame surface has a width along at least a portion thereof in the range of 1/16–3/4 inch.

19. The combination according to claim 18 wherein the frame surface has a substantially uniform width through at least 180° around the perimeter edge of the design piece.

20. The combination according to claim 16 wherein the thread is woven to produce the at least part of the viewable design.

21. The combination according to claim 16 wherein the perimeter edge of at least one of the substrate layers is cut and at least a part of the perimeter edge of the at least one of the substrate layers is exposed without any thread wrapped therearound.

* * * * *